US008984675B2

(12) United States Patent
Miller et al.

(10) Patent No.: US 8,984,675 B2
(45) Date of Patent: Mar. 24, 2015

(54) CONTROL SYSTEM FOR A PLURALITY OF TOILETS AND RELATED METHOD

(75) Inventors: James Miller, Manchester, MI (US); Rick Danks, Jackson, MI (US); Ian Vivero, Middlefield, CT (US)

(73) Assignee: Thetford Corporation, Ann Arbor, MI (US)

( * ) Notice: Subject to any disclaimer, the term of this patent is extended or adjusted under 35 U.S.C. 154(b) by 905 days.

(21) Appl. No.: 11/846,925

(22) Filed: Aug. 29, 2007

(65) Prior Publication Data

US 2008/0053532 A1 Mar. 6, 2008

Related U.S. Application Data

(60) Provisional application No. 60/841,676, filed on Aug. 31, 2006.

(51) Int. Cl.

| | |
|---|---|
| ***E03D 1/00*** | (2006.01) |
| ***E03F 1/00*** | (2006.01) |
| ***E03D 5/10*** | (2006.01) |

(52) U.S. Cl.

CPC ..... *E03F 1/006* (2013.01); *E03D 5/105* (2013.01)

USPC ..... 4/314; 4/313; 4/406

(58) Field of Classification Search

USPC ..... 4/313, 314, 406, DIG. 3

See application file for complete search history.

(56) References Cited

U.S. PATENT DOCUMENTS

| | | | | |
|---|---|---|---|---|
| 3,908,204 | A * | 9/1975 | Hopkins | 4/406 |
| 4,324,007 | A * | 4/1982 | Morris | 4/321 |
| 4,521,925 | A | 6/1985 | Chen et al. | |
| 4,651,359 | A | 3/1987 | Battle | |
| 4,886,607 | A * | 12/1989 | Lalonde et al. | 210/739 |
| 4,918,762 | A * | 4/1990 | Uhlmann | 4/303 |
| 5,036,553 | A * | 8/1991 | Sanderson | 4/313 |
| 5,409,037 | A * | 4/1995 | Wheeler et al. | 137/551 |
| 5,469,586 | A | 11/1995 | Tsutsui et al. | |
| 2007/0113330 | A1 | 5/2007 | Miller | |
| 2007/0113331 | A1 * | 5/2007 | Prokopenko et al. | 4/425 |
| 2007/0256221 | A1 | 11/2007 | Schagen | |

FOREIGN PATENT DOCUMENTS

| | | | |
|---|---|---|---|
| EP | 0 446 504 | A1 | 9/1991 |
| EP | 0 861 947 | A1 | 9/1998 |
| GB | 2 137 248 | A | 10/1984 |

OTHER PUBLICATIONS

U.S. Appl. No. 60/791,953, filed Apr. 13, 2006, Grech.

U.S. Appl. No. 60/792,381, filed Apr. 14, 2006, Miller.

Partial European Search Report for Application No. EP 06 02 1845, dated Jan. 14, 2009, 3 Pages.

European Search Report for Application No. EP 07 01 6966, dated Sep. 24, 2010.

Office Action from the European Patent Office regarding European Patent Application 07 016 966.9-2315, dated Sep. 16, 2011.

* cited by examiner

*Primary Examiner* — Lauren Crane

(74) *Attorney, Agent, or Firm* — Harness, Dickey & Pierce, P.L.C.

(57) ABSTRACT

An adapter includes an interface module that receives signals from a first sensor that indicate a first fill status of a holding tank. A control module of the adapter generates a control signal based on the first fill status. The toilet is at least partially controlled by a toilet control module that restricts a flush capability of the toilet based on the control signal. An isolation module of the adapter isolates the interface module and the control module from at least one of voltage and current fluctuations that are external to the adapter.

18 Claims, 4 Drawing Sheets

CONTROL SYSTEM FOR A PLURALITY OF TOILETS AND RELATED METHOD

CROSS-REFERENCE TO RELATED APPLICATIONS

This application claims the benefit of U.S. Provisional Application No. 60/841,676, filed on Aug. 31, 2006. The disclosure of the above application is incorporated herein by reference in its entirety.

FIELD

The present disclosure relates to waste management and, more particularly, to a control system for a plurality of toilets and related method.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Toilet systems may require dedicated sensors that indicate fill levels for a holding tank. In applications including multiple toilets coupled to a common holding tank, each toilet may be responsive to a respective level sensor. The sensor may indicate tank fill status and whether a flush lockout is necessary. A flush lockout may be necessary if the tank is full. Multiple toilets may therefore result in holding tanks littered with sensors.

Further, each of the sensors may need to communicate with a control module on each respective toilet. Thus multiple cables may need to be run to respective toilets from the holding tank.

SUMMARY

An adapter includes an interface module that receives signals from a first sensor that indicate a first fill status of a holding tank. A control module of the adapter generates a control signal to restrict a flush capability of a toilet based on the first fill status. The toilet is at least partially controlled by a toilet control module that responds to the control signal. An isolation module of the adapter isolates the interface module and the control module from at least one of voltage and current fluctuations that are external to the adapter.

In other features, the control module compares the first fill status to a predetermined shut-off fill status that indicates that the holding tank is full. The control module indicates that the holding tank is full by illuminating a first light-emitting device. The interface module receives signals from a second sensor that indicate a second fill status of the holding tank. The control module compares the second fill status to a predetermined notification fill status that indicates that the holding tank is becoming full.

In other features, the control module indicates that the holding tank is becoming full by illuminating a second light-emitting device. A third light-emitting device is active in response to the isolation module electrically communicating with at least one of the toilet control module and the first sensor. The first, second, and third light-emitting devices comprise light-emitting diodes.

In other features, the isolation module includes an opto-isolator circuit. The opto-isolator circuit includes at least one of an optical isolator, an optocoupler, a photocoupler, and a photo metal oxide semiconductor (photo MOS). The control module bases the restriction on a variation in a predetermined current from the interface module. The predetermined current is based on the first sensor signal.

In other features, a toilet control system includes the adapter and further includes the holding tank. The first sensor communicates with contents of the holding tank. The toilet system also includes a plurality of adapters and a plurality of toilets and respective toilet control modules. Each of the adapters receives signals from the first sensor and controls one of the toilet control modules based on the signals.

Alternatively, the toilet control system includes a plurality of toilets and respective toilet control modules. The adapter controls the toilet control modules based on the signals. Alternatively, the toilet control modules respond to adapter signals that are merely translations of sensor signals. The first sensor includes at least one of a capacitive sensor, a reed switch, a Hall effect sensor, a mechanical float switch, an electro-mechanical float switch, an optical sensor, and an acoustic sensor.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
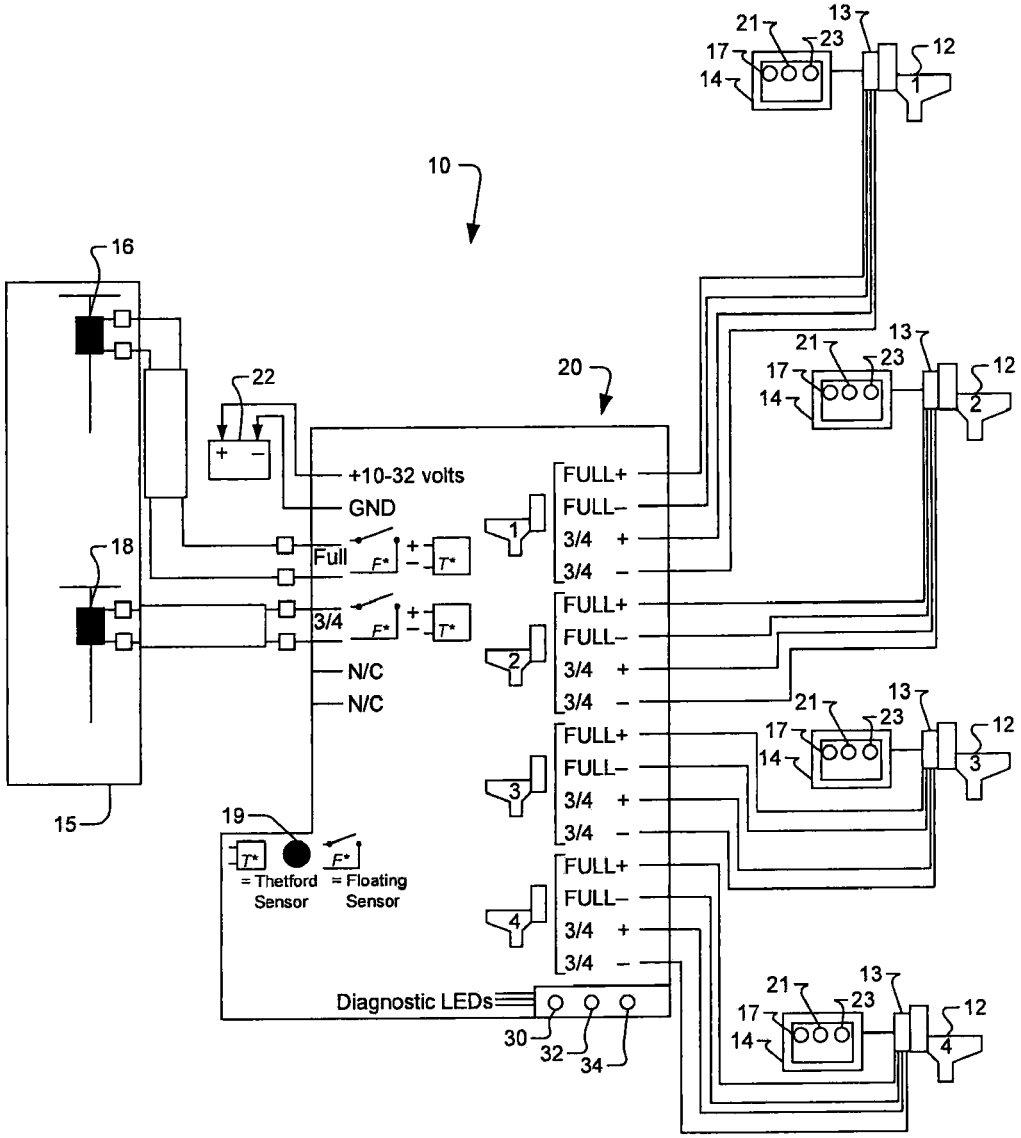
FIG. 1 is a simplified schematic diagram of a control system for a plurality of toilets according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

In one particular application, the teachings of the present disclosure may be used in connection with a vehicle having a plurality of toilets and a common waste holding tank. For example, the present teachings may be used with a seagoing vessel with a plurality of toilets connected to a common on-board holding tank. Various other vehicle and non-vehicle applications are anticipated within the scope of the present disclosure.

The present disclosure may be utilized with various toilets including, but not limited to, macerator toilets. One suitable toilet for use with the present teachings is shown in described in U.S. Ser. No. 791,953 entitled Macerator Toilet and filed on Apr. 13, 2006. U.S. Ser. No. 791,953 is hereby incorporated by reference in its entirety.

Referring now to FIG. 1, an electronic control system in accordance with the present disclosure is illustrated and identified at reference numeral 10. The control system 10 is shown operatively associated with a plurality of toilets 12. As illustrated, the system 10 is shown associated with four toilets 12. As will be appreciated more fully below, however, the system 10 may be readily adapted within the scope of the present teachings to accommodate a greater or lesser number of toilets 12. The flush toilets 12 illustrated in the drawing may be macerator toilets 12. Other types of flush toilets may also be used.

Each of the toilets 12 is associated with a separate electronic control module 13 and a user interface 14. A suitable electronic control module and user interface are described in further detail in commonly assigned U.S. Ser. No. 60/792,381 entitled flush toilet control system and related method. U.S. Ser. No. 60/792,381 is hereby incorporated by reference in its entirety. Each of the toilets 12 may be in communication with a waste holding tank 15. For vehicle applications, the waste holding tank may be an on-board waste holding tank.

The control system 10 may include one or more tank level sensors 16, 18 for sensing the level of waste within the waste holding tank 15. Each tank level sensor 16, 18 may include a plurality of reed switches, for example. The sensors 16, 18 may also include Hall effect sensors and/or any other type of magnet based sensor. The sensors 16, 18 may also include capacitive type sensors that have specific fields and high frequencies. Further, the sensors may include mechanical or electromechanical float sensors, optical sensors, and/or acoustic sensors. The control system 10 may also include a switch 19 to switch from one type of sensor to another. In other words, the system may interact with different tanks and/or different sensors. The control system 10 may be switched to a mode that corresponds to the given sensor type.

The plurality of sensors may include a first electromechanical sensor 16 for generating a signal to indicate that the holding tank is substantially full and a second sensor 18 to indicate that the holding tank 15 is partially full.

The user interface 14 may include an indicator 17 for indicating a level of waste in the holding tank 15. The indicator 17 may cooperate with the tank level sensors 16, 18 and may be controlled by the associated control module 13 to differentiate between various levels within the holding tank 15. The indicator 17 may indicate when the holding tank 15 is partially full and substantially full. The indicator 17 may include a graphical representation of a holding tank 15, which may be illuminated by a light-emitting device that may include a permanent or varying color. The color may indicate available capacity.

For example, the indicator 17 may be in a first color (e.g., yellow) when the holding tank 15 is partially full (e.g., three-quarters full), a second color (e.g., red) when the holding tank 15 is substantially full, and a third color (e.g., white) when the holding tank 15 is less than half full. The control system 10 may automatically use the control modules 13 of the toilets 12 to implement a "Lockout" mode upon sensing of a tank level above a predetermined level (e.g., approximately 90% full). In other words, the control modules 13 may lockout some or all of the toilets 12 to prevent overfilling of the holding tank 15. Alternatively, the user interface 14 may include multiple indicators, such as first, second, and third indicators 17, 21, 23 that may all include different colored light-emitting devices, such as light-emitting diodes (LEDs). The indicators 17, 21, 23 may represent different tank fill status levels.

The control system 10 may include an adapter 20. The adapter 20 may be located remote from the toilet 12. The adapter 20 is embodied as a Multiple Toilet Adapter (MTA), however Single Toilet Adapters (STAs) are also contemplated and will be discussed later within the present disclosure. The adapter 20 receives signals from the sensors 16, 18 indicative of the holding tank 15 level. The adapter 20 is also coupled to the control module 13 of each of the toilets 12 through a multi-conductor cable or bus. The adapter is powered by a battery 22 although various other power sources may be used.

The adapter 20 may operate to translate the characteristics of the sensors 16, 18 directly to each of the plurality of toilets 12 and respective control modules 13. In this regard, the adapter 20 functions to replicate and/or multiplex the signals received from the sensors 16, 18. In this manner, the signals generated by the adapter 20 and directed to the individual toilets 12 are independent signals that can easily be routed to each of the toilets 12. These signals may be isolated from one another. Signals from the adapter 20 may be referred to as control signals. The control signals may include translations of sensor data and/or signals that control functions of the control modules 13.

In operation, when the holding tank 15 is less than the predetermined amount full (e.g. less than three-fourths full), the adapter 20 may generate a corresponding signal for each of the control modules 13 to illuminate the first indicator 17 and allow full operation of the toilet 12. When the holding tank 15 reaches the predetermined level, the second sensor 18 generates a signal that is replicated by the adapter 20. The control modules 13 may respond to this replicated signal by illuminating a second indicator 21 of each of the user interfaces 14. The second indicator 21 indicates to the user that the system 10 remains fully functional, but the holding tank 15 has reached the predetermined fill status. The control modules 13 may also shut off toilet pumps so that the toilets do not continue to pump waste to the holding tank 15 based on sensor signals.

When the holding tank 15 reaches a substantially full level, the first sensor 16 generates a signal that is again replicated by the adapter 20. This replicated signal in turn may control the control modules 13 to illuminate a third indicator 23 of each of the user interfaces 14. Either or both of the control modules 13 and the adapter 20 may use the first or second sensor signals to limit flushing of the toilets 12. The adapter 20 may also include diagnostic LEDs 30, 32, 34 that may indicate tank full, tank partially full, and connection to the sensors 16, 18, respectively.

Figure 2:
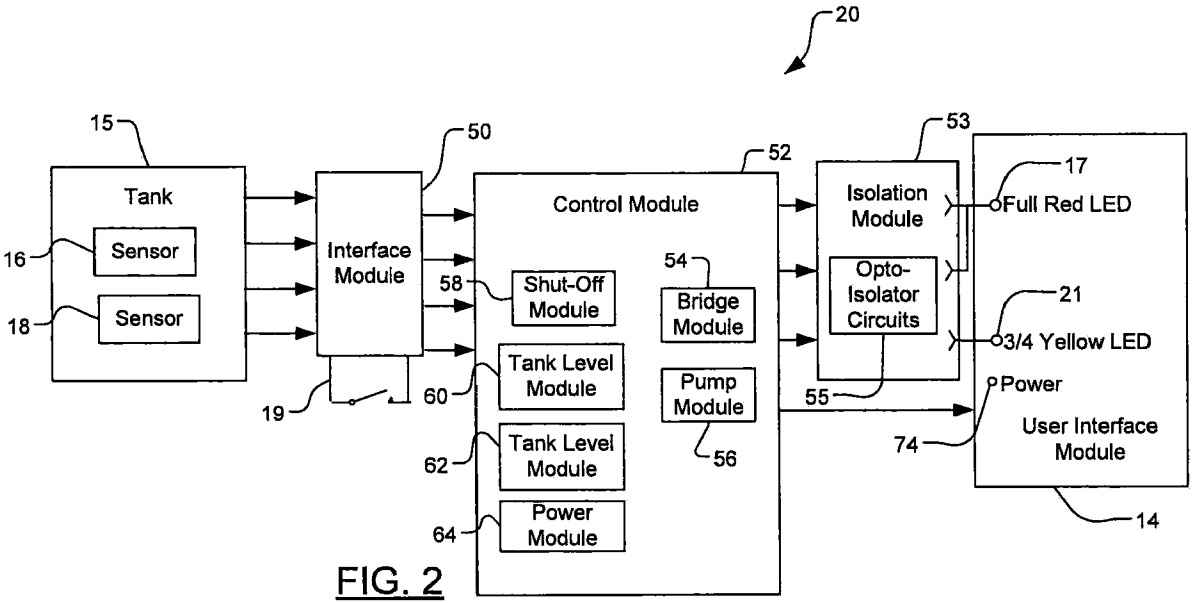
FIG. 2 is a functional block diagram of an adapter for the control system of FIG. 1.
Figure 3:
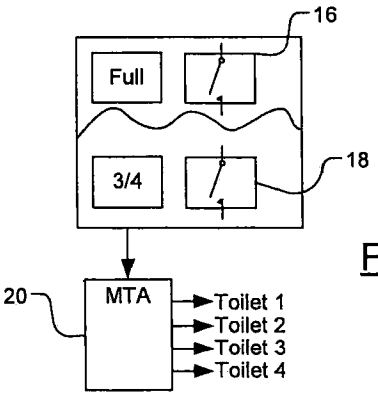
FIG. 3 is a simplified schematic view of a control system for a plurality of toilets according to the present disclosure.

Referring now to FIG. 2, the adapter 20 may include an interface module 50, a control module 52, and an isolation module 53. The control module 52 may include a vessel bridge module 54, a pump relay module 56, a shut-off module 58, tank level modules 60, 62, and a power module 64. The interface module 50 interfaces with the sensors 16, 18 that sense data from the tank 15. Numerous sensors may sense data from the tank although only two are illustrated. The control module 52 may determine the tank level based on sensor signals and may also determine appropriate responses to the tank levels. The control module 52 may determine the type of sensors attached and/or the number and type of toilets attached.

The isolation module 53 isolates the adapter 20 and the sensors 16, 18 from external variances in current and/or voltage. In other words, the isolation module 53 makes a varying load appear as a constant current load. In applications where different toilets 12 are interconnected to the adapter 20 through different lengths of cable, the isolation module 53 may eliminate problems associated with different line voltages. The toilets 12 may be connected to the adapter 20 via the isolation module 53 over a length of 100 feet or more.

The interface module 50 interfaces with the sensors 16, 18 that sense data from the tank 15. The sensors 16, 18 may always signal their presence. The interface module 50 may provide a predetermined constant current to the control module 52 based on the sensor signals. The sensors 16, 18 may provide variations in the current in response to sensing that the holding tank 15 is filling. The control module 52 may base responses to sensor signals on fluctuations in the constant current.

For example, the sensors 16, 18 may draw constant 12 milliamps (ma) of current. The control module 52 may determine that if the interface module 50 receives 12 ma, then the holding tank 15 is empty. If the interface module indicates 20 ma, the holding tank 15 is full. If the interface module indicates 25 ma or more, then the sensors 16, 18 may be shorted.

The tank level modules 60, 62 may determine an exact level of the tank 15 based on the sensor signals but may only respond to predetermined notification and full levels. The sensors 16, 18 may constantly provide signals to the tank level modules 60, 62. The notification levels may be any level less than full, such as three-quarters full. The bridge module 54 may isolate portions of the adapter 20 from the toilets 12. The pump relay module 56 may send a signal to the vessel (that includes the toilet system) that the tank may be full and may need to be pumped out. The pump relay module 56 may also relay various other information to the vessel, such as that the tank is empty and/or not attached.

The control module 52 may determine the tank level based on sensor signals and may also determine appropriate responses to the tank levels. Appropriate responses may include lighting indicators 17, 21 to indicate tank levels. For example, the tanks level module 60 may control a red LED when the tank is full. The tank level module 62 may control a yellow LED when the tank is three-quarters full. The power module 64 may also maintain another indicator 74, such as a green LED, to indicate that the adaptor 20 is receiving adequate power. The shut-off module 58 may lock out attached toilets when the sensors are disconnected, shorted, and/or when the tank is full.

The isolation module 53 maintains isolation from external power sources so that a relatively constant current is used by the control module 52 to control the adapter 20. For example, large ships may include multiple toilets in multiple locations. The toilets may include controllers that communicate with different ground lines. Alternatively, the toilets may have a common ground that has several voltage drops between a toilet and the adapter 20. The isolation module 53 may completely isolate the rest of the adapter 20 from voltage/current fluctuations on both different ground lines and the common ground line.

The isolation module 53 may include a plurality of isolator circuits 55, such as an optical isolator, optocoupler, photocoupler, a photo metal oxide semiconductor (photo MOS), an inductive isolator circuit or a capacitive isolator circuit that may be connected in parallel or in series.

The optical isolator circuits 55 may use short optical transmission paths to transfer signals between adaptor elements while keeping the signals electrically isolated. When a signal is applied to the input of the isolator circuits 55, LED lights and a responsive light sensor may activate. A corresponding electrical signal may then be generated at the output of the opto-isolator circuit. The opto-isolator circuits separate the adaptor 20 from all external sources and provide a constant current regardless of external signals from the toilets 12, common, or different grounds, etc. Therefore, lines to various toilets 12 may be long, connected to different grounds, include voltage drops, electrical noise, etc.

Figure 5:
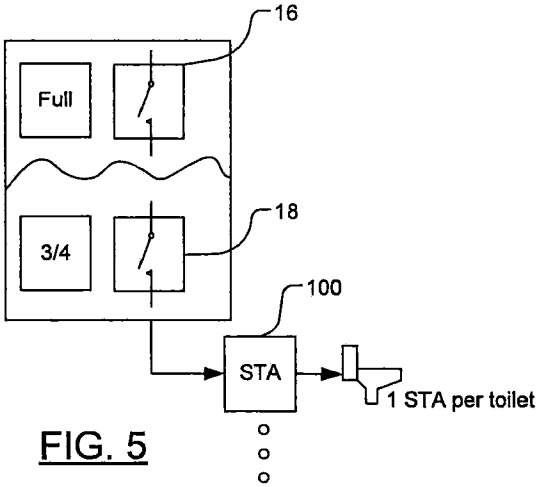
FIG. 5 is a simplified schematic view of a control system for a plurality of toilets according to the present disclosure.
Figure 4:
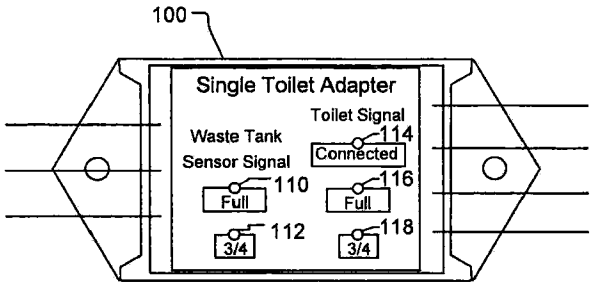
FIG. 4 is another adapter according to the present disclosure.
Figure 6:
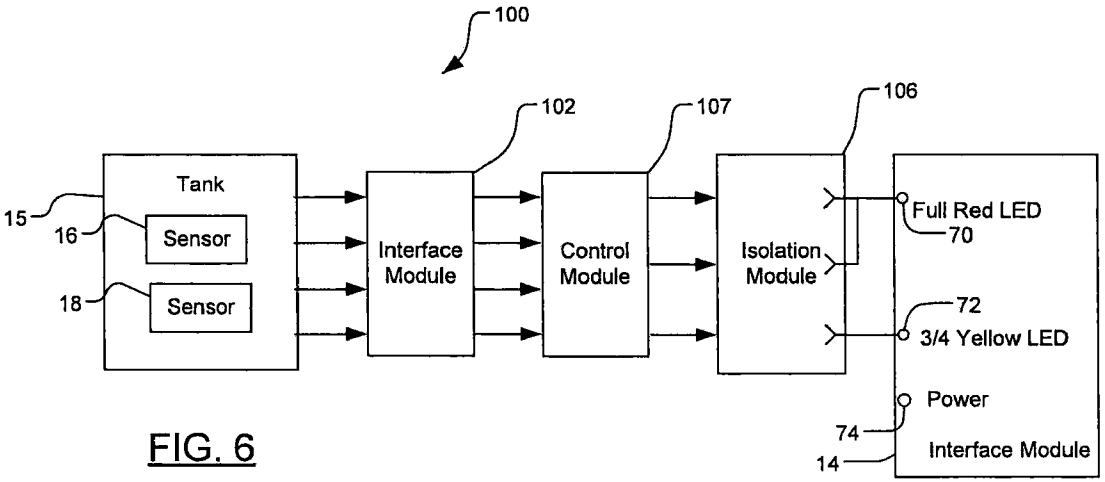
FIG. 6 is a functional block diagram of a toilet control system including the adapter of FIG. 4.

Referring now to FIGS. 4-6, a Single Toilet Adapter (STA) 100 is illustrated. The adapter 100 may include an interface module 102 to provide constant current from the sensors 16, 18. The adapter 100 may also include an isolation circuit 106 that isolates the adapter 100 from external current variations. The adapter 100 may also receive on/off signals from the sensors 16, 18 instead of constant signals. The adapter 100 may also include a control module 107. One adapter 100 may be provided for each toilet 12 in the system.

The adapter 100 may include LEDs 110, 112 that indicate that the holding tank 15 is full. The adapter 100 may also include LEDs 114, 116 that indicate that the toilet control module 13 has been notified of the tank condition. Another LED 118 may indicate that the sensors 16, 18 are properly connected and/or the toilet 13 is properly connected.

Figure 7:
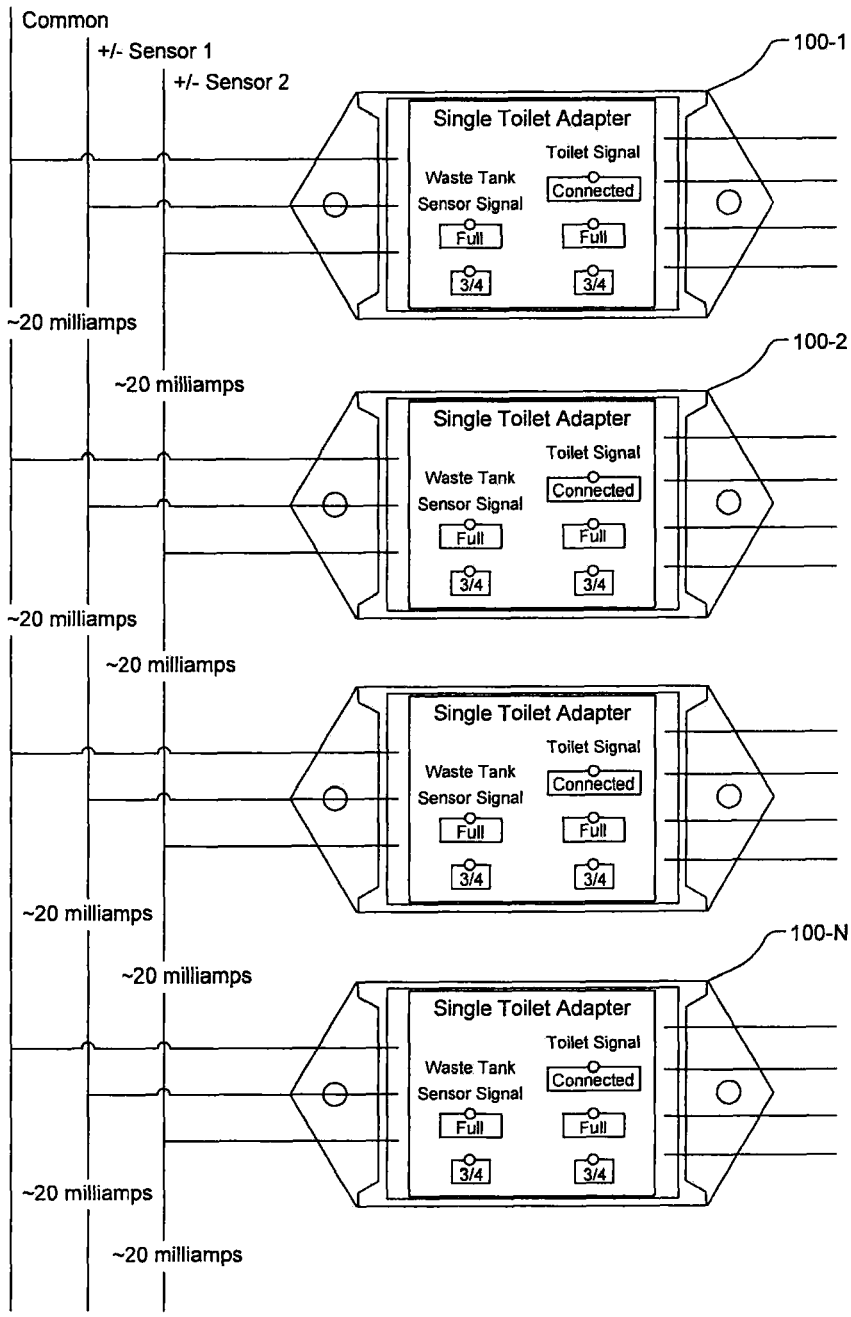
FIG. 7 is a simplified schematic diagram of a plurality of adapters according to the present disclosure.

Referring now to FIG. 7, multiple Single Toilet Adapters 100-1, 100-2, . . . , and 100-N may receive signals from a single set of sensors 16, 18 and translate the signals to respective toilets. Basically, the adapters 100-1, 100-2, . . . , and 100-N detect the sensors 16, 18 and indicate an open circuit if the sensors 16, 18 are not connected. The isolation module 106 may detect sensors and determine the type of sensors that are attached, and the control module 107 may respond accordingly.

For example, if float sensors are attached, the adapter 20 need only respond to two conditions because float sensors may only have two conditions, open or closed. Open corresponds to either an empty tank or a disconnected sensor. Closed corresponds to a full tank or partially full tank. The isolation module 106 may also translate sensor information into an indication that the sensors are connected to the adapter 100.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A waste handling system comprising:

a plurality of toilets;

a plurality of toilet control modules, each said toilet control module being independently associated with a respective one of said toilets such that each said toilet control module is able to independently control a flushing operation of its associated said toilet;

a waste holding tank in communication with each of said toilets;

a first sensor associated with said waste holding tank that is configured to indicate a first fill status of said waste holding tank;

a plurality of second sensors each associated with a respective toilet of said toilets and configured to identify a type for said respective toilet of the plurality of toilets;

an adapter system for interfacing said first sensor to each of said toilet control modules, said adapter system including:

an interface module that receives signals from the first sensor that indicate the first fill status of the waste holding tank;

a control module that:

determines a number and type of the plurality of toilets being used with the system based on input from the plurality of second sensors;

generates a control signal based on said first fill status, wherein each said toilet is independently controlled by its respective said toilet control module such that each said toilet control module is able to restrict a flush capability of its respective said toilet based on said control signal, irrespective of an operation of any other ones of said toilets, and further such that flushing of any one or more of said toilets may be initiated regardless if any other one of said toilets is being simultaneously flushed;

the control module being configured to use the interface module to visually indicate:

a first condition where a level of waste in the waste holding tank is below a first predetermined level, and during which all of the toilets are allowed to flush;

a second condition where the level of waste in the waste holding tank has reached a substantially full level, but during which all of the toilets are still allowed to flush; and a third condition in which a level of waste in the waste holding tank is above a predetermined upper level, indicating that the waste holding tank is full, and during which selected ones or more of the toilets are locked out to prevent flushing;

an isolation module that isolates said interface module and said control module from at least one of voltage and current fluctuations that are external to the adapter.

2. The waste handling system of claim 1, wherein said control module of said adapter system compares said first fill status to a predetermined shut-off fill status to determine and indicate when said waste holding tank is full.

3. The waste handling system of claim 2, wherein said adapter system further comprises a first light-emitting device wherein said control module indicates that said waste holding tank is full by illuminating said first light-emitting device.

4. The waste handling system of claim 3, wherein said interface module of said adapter system receives signals from a second sensor associated with said holding tank that indicate a second fill status of said waste holding tank, and wherein said control module compares said second fill status to a predetermined notification fill status that indicates that said waste holding tank is becoming full.

5. The waste handling system of claim 4, further comprising a second light-emitting device, wherein said control module indicates that said waste holding tank is becoming full by illuminating said second light-emitting device.

6. The waste handling system of claim 5, further comprising a third light-emitting device associated with said adapter system, wherein said third light-emitting device is active in response to said isolation module electrically communicating with at least one of said toilet control module and said first sensor.

7. The waste handling system of claim 6, wherein said first, second, and third light-emitting devices comprise light-emitting diodes.

8. The waste handling system of claim 1, wherein said isolation module comprises an isolator circuit.

9. The waste handling system of claim 1 wherein said interface module indicates a predetermined current from said first sensor.

10. The waste handling system of claim 9, wherein said control module bases said restriction on a variation in said current from said interface module based on said first sensor signal.

11. The waste handling system of claim 1, further comprising a plurality of adapters systems each being independently associated with a respective one of said toilets and a respective one of said toilet control modules, wherein each of said plurality of adapter systems receive signals from said first sensor and generates control signals based on said signals and said toilet control modules respond to said control signals to independently control a flushing action of its associated said toilet.

12. A toilet control system comprising:

a plurality of toilets each including respective toilet control modules that independently control flush operations of their respective said toilets, to thus enable any selected one or more of said plurality of toilets to be flushed while any other one or more non-selected ones of said plurality of toilets are disabled from flushing, and further such that operation of any one or more selected ones of said plurality of toilets may occur regardless if flushing is already occurring with any other one or more of said toilets;

a holding tank that fills based on said flush operations;

a first sensor that generates a first signal indicative of a current fill status of said holding tank;

a plurality of second sensors each associated with a respective toilet of said toilets and configured to identify a type for said respective toilet of the plurality of toilets;

an adapter comprising:

an interface module that receives said first signal;

a control module that:

determines a type and number of the plurality of toilets being used by the system based on input from the plurality of second sensors;

compares said fill status to a predetermined shut-off fill status that indicates that said holding tank is substantially full and that halts said flush operations based on said comparison, by independently sending a control signal to one or more of said toilet control modules;

the control module being configured to use the interface module to visually indicate:

a first condition where a level of waste in the holding tank is below a first predetermined level, and during which all of the toilets are allowed to flush;

a second condition where the level of waste in the holding tank has reached a substantially full level, but during which all of the toilets are still allowed to flush; and a third condition in which a level of waste in the waste holding tank is above a predetermined upper level, indicating that the waste holding tank is full, and during which selected ones or more of the toilets are locked out to prevent flushing; and an isolation module that isolates said adapter from at least one of voltage and current fluctuations between said toilet control modules and said adapter.

13. The toilet control system of claim 12, further comprising a second sensor, wherein said interface module receives signals from a second sensor associated with said holding tank that indicate a second fill status of said holding tank, and wherein said control module compares said second fill status to a predetermined notification fill status that indicates that said holding tank is becoming full.

14. The toilet control system of claim 12, further comprising a light-emitting device, wherein said light-emitting device is active based on said isolation module electrically communicating with at least one of said toilet control modules and said first sensor.

15. The toilet control system of claim 12, wherein said isolation module comprises a plurality of isolator circuits that isolate said adapter from said control modules, wherein said isolator circuits comprise at least one of an optical isolator, an optocoupler, a photocoupler, a photo metal oxide semiconductor (photo MOS), a capacitive isolator, and an inductive isolator.

16. A method for controlling a toilet system comprising:

providing each of a plurality of toilets with an independently controllable toilet control module that is configured to assist in controlling a flushing operating of its associated said toilet;

providing a plurality of sensors each associated with a respective toilet and configured to identify a type for said respective toilet;

independently controlling respective flush operations of a plurality of toilets such that any of said toilets may be flushed regardless if a flushing action is already occurring with any other one or more of said toilets;

filling a holding tank based on said flush operations;

generating a first signal that indicates a current fill status of said holding tank;

comparing said fill status to a predetermined shut-off fill status that indicates that said holding tank is substantially full;

using a control module to:

determine a type and number of the plurality of toilets being connected to the system with input from the plurality of sensors;

generate control signals that are applied independently to each of said toilet control modules, to halt said flush operations of at least a subplurality of selected ones of said plurality of toilets based on said comparison;

visually indicate:

a first condition where a level of waste in the holding tank is below a first predetermined level, and during which all of the toilets are allowed to flush;

a second condition where the level of waste in the holding tank has reached a substantially full level, but during which all of the toilets are still allowed to flush; and a third condition in which a level of waste in the waste holding tank is above a predetermined upper level, indicating that the waste holding tank is full, and during which selected ones or more of the toilets are locked out to prevent flushing; and isolating at least one of voltage and current fluctuations within the toilet system.

17. The toilet control system of claim 12, wherein the holding tank is a waste holding tank positioned remote relative to each toilet of the plurality of toilets.

18. The toilet control system of claim 17, wherein the waste holding tank is in fluid communication with each toilet of the plurality of toilets.

* * * * *